US010506824B2

(12) United States Patent
Kadiric

(10) Patent No.: US 10,506,824 B2
(45) **Date of Patent: *Dec. 17, 2019**

(54) SMOKING ARTICLE MOUTHPIECE WITH COOLING AGENT INCLUSION COMPLEX

(71) Applicant: Philip Morris Products S.A., Neuchatel (CH)

(72) Inventor: Alen Kadiric, Orpund (CH)

(73) Assignee: PHILIP MORRIS PRODUCTS S.A., Neuchâtel (CH)

( * ) Notice: Subject to any disclaimer, the term of this patent is extended or adjusted under 35 U.S.C. 154(b) by 86 days.

This patent is subject to a terminal disclaimer.

(21) Appl. No.: 15/924,588

(22) Filed: Mar. 19, 2018

(65) Prior Publication Data

US 2018/0220699 A1 Aug. 9, 2018

Related U.S. Application Data

(63) Continuation of application No. 14/398,041, filed as application No. PCT/IB2013/052097 on Mar. 15, 2013, now Pat. No. 9,949,505.

(60) Provisional application No. 61/640,237, filed on Apr. 30, 2012.

(30) Foreign Application Priority Data

Apr. 30, 2012 (EP) ..... 12166193

(51) Int. Cl.

| | |
|---|---|
| ***A24D 3/04*** | (2006.01) |
| ***A24B 15/40*** | (2006.01) |
| ***A24B 15/34*** | (2006.01) |
| ***A24B 15/28*** | (2006.01) |
| ***A24D 3/06*** | (2006.01) |
| ***A24D 3/10*** | (2006.01) |
| ***A24D 3/14*** | (2006.01) |
| ***A24D 3/18*** | (2006.01) |

(52) U.S. Cl.

CPC ..... *A24D 3/048* (2013.01); *A24B 15/282* (2013.01); *A24B 15/284* (2013.01); *A24B 15/34* (2013.01); *A24B 15/403* (2013.01); *A24D 3/061* (2013.01); *A24D 3/063* (2013.01); *A24D 3/067* (2013.01); *A24D 3/10* (2013.01); *A24D 3/14* (2013.01); *A24D 3/18* (2013.01)

(58) Field of Classification Search

None

See application file for complete search history.

(56) References Cited

U.S. PATENT DOCUMENTS

| | | | | |
|---|---|---|---|---|
| 3,288,146 | A | 11/1966 | Bayley et al. | |
| 4,966,171 | A | 10/1990 | Serrano et al. | |
| 5,137,034 | A * | 8/1992 | Perfetti | A24B 15/165 131/194 |
| 5,165,943 | A | 11/1992 | Patel et al. | |
| 5,479,949 | A | 1/1996 | Battard et al. | |
| 5,725,865 | A | 3/1998 | Mane et al. | |
| 5,752,529 | A | 5/1998 | Mane et al. | |
| 6,214,788 | B1 * | 4/2001 | Velazco | A23G 3/36 512/19 |
| 7,789,089 | B2 | 9/2010 | Dube et al. | |
| 8,864,909 | B2 * | 10/2014 | Mishra | A24B 15/283 131/275 |
| 9,949,505 | B2 * | 4/2018 | Kadiric | A24B 15/282 |
| 2010/0108081 | A1 | 5/2010 | Blevins Joyce et al. | |
| 2011/0091531 | A1 * | 4/2011 | Furrer | A23G 4/06 424/450 |
| 2015/0107608 | A1 | 4/2015 | Kadiric | |

FOREIGN PATENT DOCUMENTS

| | | | | |
|---|---|---|---|---|
| AU | 718673 | B2 | 4/2000 | |
| EP | 0503795 | A2 | 9/1992 | |
| EP | 0472367 | B1 | 3/1996 | |
| EP | 1 040 765 | B1 | 10/2006 | |
| JP | H05-146285 | A | 6/1993 | |
| JP | H09-510627 | A | 10/1997 | |
| JP | 4695741 | | 6/2011 | |
| JP | 2011-520925 | A | 7/2011 | |
| JP | 2018-57390 | A | 4/2018 | |
| WO | WO-9323005 | A1 * | 11/1993 | A23G 3/36 |
| WO | WO 2007/076025 | A2 | 7/2007 | |
| WO | WO 2008/075942 | A1 | 6/2008 | |
| WO | WO 2009/027331 | A2 | 3/2009 | |
| WO | WO 2009/140783 | A1 | 11/2009 | |
| WO | WO 2010/051076 | A1 | 5/2010 | |

OTHER PUBLICATIONS

International Search Report and Written Opinion for PCT/IB2013/052097, dated Aug. 2, 2013; 11 pgs.

International Preliminary Report on Patentability for PCT/IB2013/052097, dated Nov. 13, 2014 from the International Bureau of WIPO; 8 pgs.

Japanese Office Action dated Sep. 18, 2018, including English Translation; 8 pgs.

* cited by examiner

*Primary Examiner* — Dennis R Cordray

(74) *Attorney, Agent, or Firm* — Mueting, Raasch & Gebhardt, P.A.

(57) ABSTRACT

A smoking article includes a mouthpiece having an outer surface and a cooling agent inclusion complex disposed on the outer surface.

17 Claims, 1 Drawing Sheet

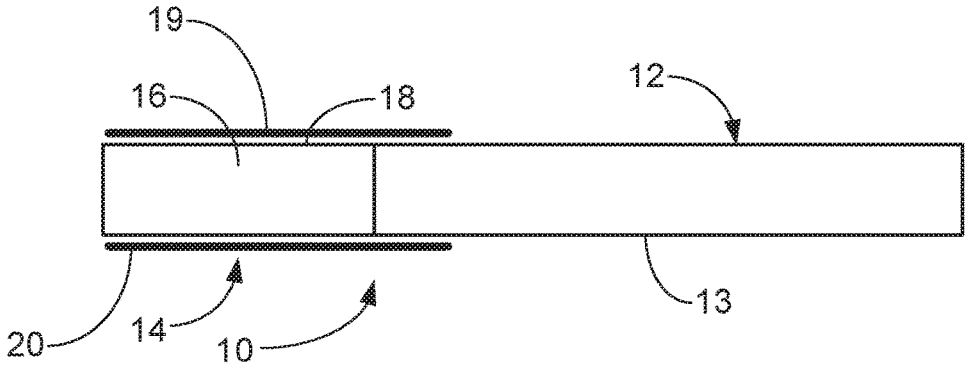
19
16
18
12
20
14
10
13

SMOKING ARTICLE MOUTHPIECE WITH COOLING AGENT INCLUSION COMPLEX

This application is a continuation application of U.S. patent application Ser. No. 14/398,041 (pending), filed 30 Oct. 2014, which is the § 371 U.S. National Stage of International Application No. PCT/162013/052097, filed 15 Mar. 2013, which claims the benefit of U.S. Provisional Application No. 61/640,237, filed 30 Apr. 2012 and European Application No. 12166193.8, filed 30 Apr. 2012, which are incorporated by reference herein in their entireties.

The present disclosure relates to a smoking article with a mouthpiece that includes a cooling agent inclusion complex on an outer surface of the mouthpiece.

Smoking articles typically include a tobacco substrate portion and a mouthpiece portion. The mouthpiece portion contacts the mouth or lips of a consumer. Many combustible smoking articles, such as cigarettes, utilize a wrapper layer, known as a "tipping" wrapper to join the mouthpiece to the tobacco substrate. This wrapper layer typically forms the outer layer of the mouthpiece portion of the smoking article, or the layer that comes into contact with the mouth or lips of the consumer. Other smoking articles are designed to use heat, air flow, a chemical reaction, or a combination of these mechanisms, to deliver a component of the tobacco substrate to the consumer. Many of these non-combustible smoking articles also include a wrapper material around a mouthpiece portion, where the wrapper material comes into contact with the mouth or lips of the consumer.

Some smoking articles seek a refreshing sensation by utilizing a cooling agent such as menthol for example. These cooling agents provide a physiological cooling sensation when these cooling agents vaporize and are contacted with the human body and, in particular, with the mucous membranes of the mouth, nose and throat.

For certain smoking articles, it is desirable to provide a stable cooling agent on an outer surface of a smoking article mouthpiece to provide a cooling sensation to a user. It is desirable that this cooling agent remain on the intended surface of the smoking article mouthpiece so that the cooling agent can provide a predictable physiological cooling sensation to the user's lips during the smoking experience. It is also desirable that the stable cooling agent not provide unwanted volatile taste components that alter the expected taste experience provided by the smoking article.

According to the current disclosure, there is provided a smoking article with a mouthpiece having an outer surface and a cooling agent inclusion complex disposed on the outer surface. In many embodiments, the cooling agent is a non-volatile compound or a non-menthol compound. The cooling agent can be a carboxamide containing compound or a menthoxy containing compound. The cooling agent and cyclodextrin inclusion complex does not migrate away from the surface on which it is disposed. In many embodiments, the inclusion complex comprises a cooling agent and a cyclodextrin compound, for example a beta-cyclodextrin compound. Use of the cooling agent and cyclodextrin inclusion complex in the manufacture of a mouthpiece of a smoking article is further described below.

Smoking articles according to the present disclosure provide an effective way to provide a predictable physiological cooling sensation to the user's lips. It has been found that non-volatile cooling compounds disposed on a wrapper material of a smoking article may tend to migrate away from the surface to an inner portion of the smoking article where it cannot come into physical contact with the lips or fingers of the consumer. The cooling agent inclusion complex of the present disclosure remains stable and in place on the outer surface of the smoking article mouthpiece for an extended period of time. The cooling agent and cyclodextrin inclusion complex is odor-free and does not provide unwanted volatile taste components that alter the expected taste experience provided by the smoking article. The cooling agent inclusion complex can be disposed on tipping paper and then travel through the manufacturing and smoking article assembly process without affecting the stability of the cooling agent inclusion complex.

The term "cooling agent" refers to a compound that provides a physiological cooling sensation when contacted with the human body and, in particular, with the lips and fingers of the consumer.

The term "tipping" wrapper refers to a wrapping material that can be formed from paper or polymers or other materials and other optional filler materials. The tipping wrapper is disposed about at least a portion of a smoking article mouthpiece. Tipping wrapper typically joins the mouthpiece (such as filter element) to a tobacco substrate.

Preferably, the cooling agent is non-volatile. The term "non-volatile" refers to compounds or materials that do not evaporate readily at normal room temperature and pressure. Menthol, which can be referred to by its chemical name 2-isopropyl-5-methylcyclohexanol, is herein regarded as volatile. One measure of the term non-volatile is a compound or material having a vapour pressure less than menthol, that is, less than about 8.5 Pa, or less than about 5 Pa or less than about 2.5 Pa, all at 25 degrees centigrade.

The term "mouthpiece" refers to the portion of the smoking article that is designed to be contacted with the mouth of the consumer. In conventional smoking articles, this can be the portion of the smoking article that includes the filter, or in some cases the mouthpiece can be defined by the extent of the tipping paper. In other cases, the mouthpiece can be defined a portion of the smoking article extending about 40 mm from the mouth end of the smoking article, or extending about 30 mm from the mouth end of the smoking article.

Smoking articles according to the present disclosure include a mouthpiece with a cooling agent inclusion complex disposed on the outer surface. The cooling agent can be any useful non-volatile cooling agent or non-menthol cooling agent, or both a non-volatile and non-menthol cooling agent. In many embodiments the cooling agent has a vapour pressure that is less than the vapour pressure of menthol, that is, about 8.5 Pa at 25 degrees centigrade. In many embodiments the cooling agent has a vapour pressure that is less than about 5 Pa at 25 degrees centigrade. In some embodiments, the cooling agent has a vapour pressure that is less than about 2.5 Pa at 25 degrees centigrade.

The chemical structures and formula chemical names identified herein do not indicate specific stereochemistry. It is understood that all stereo and optical isomers of each chemical structure or chemical formula names are presumed to be included herein. A representative listing and description of cooling agents including the cooling agents described below is provided in WO 2009/027331.

In many embodiments, the cooling agent is a carboxamide containing compound. For clarity, a carboxamide group can also be referred to as an aminocarbonyl group. In many of these embodiments the carboxamide containing compound has the structure (I):

(I)

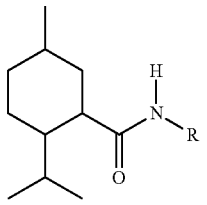

where R is a C1-C12 straight or branched chain alkyl or alkoxy, or arylene or pyridyl group. These R groups may be independently unsubstituted or substituted. These R groups may be independently unsubstituted or substituted with oxygen, nitrogen or hydroxyl groups. Preferably, R is a C1-C6 straight of branched chain alkyl or alkoxy, or arylene or pyridyl group, any of which may be unsubstituted or substituted as mentioned above. Exemplary carboxamide containing compound structures include the following:

(I-A)

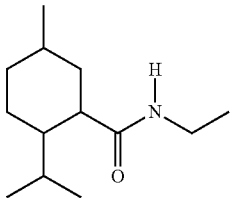

(I-B)

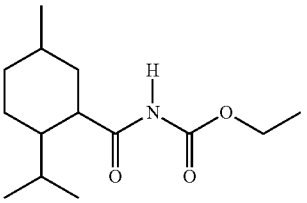

(I-C)

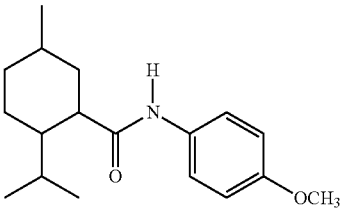

(I-D)

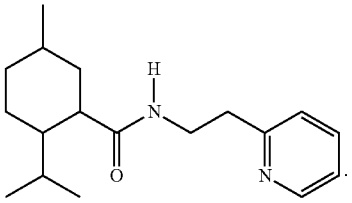

An exemplary listing of carboxamide containing compounds include: N-ethyl-p-menthane-3-carboxamide (I-A also known as WS-3); ethyl 3-(p-menthane-3-carboxamido) acetate (I-B also known as WS-5); N-(ethoxycarbonylmethyl)-p-menthane-3-carboxamide; N-(4-cyanomethylphenyl)-p-menthane carboxamide; N-(4-aminocarbonylphenyl)-p-menthane; or N-(4-methoxyphenyl)-p-menthanecarboxamide (1-C also known as WS-12); or N-(2-(pyridine-2-yl-)ethyl)-3-p-menthanecarboxamide (I-D also known as FEMA 4549). Preferred carboxamide containing compounds include N-ethyl-p-menthane-3-carboxamide (I-A) or ethyl 3-(p-menthane-3-carboxamido)acetate (I-B).

In other embodiments the carboxamide containing compound has the structure (II):

(II)

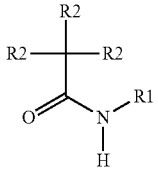

where R1 is a C1-C6 straight or branched chain alkyl or alkoxy; and each R2 is independently selected from the group consisting of C1-C3 straight or branched chain alkyl. Preferably, R1 is a C1-C4 straight of branched chain alkyl or alkoxy, and each R2 is independently selected from the group consisting of C1-C3 straight or branched chain alkyl. Exemplary carboxamide containing compound structures include the following:

(II-A)

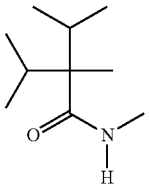

(II-B)

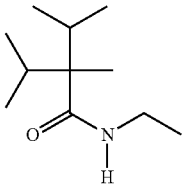

(II-C)

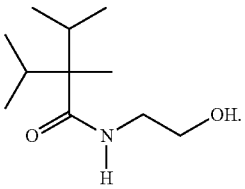

An exemplary listing of carboxamide containing compounds include: 2-isopropyl-N,2,3-trimethylbutanamide (II-A also known as WS-23); N-(2-ethoxyethyl)-2,3-dimethyl-2-isopropylbutanamide; or N-(1-isopropyl-1-methylisobutyl)anisamide; or N-ethyl-2,2-diisopropylbutanamide (II-B also known as FEMA 4557); or N-(2-hydroxyethyl)-2-isopropyl-2,3-dimethylbutanamide (II-C also known as FEMA 4602). Preferred carboxamide containing compounds include 2-isopropyl-N,2,3-trimethylbutanamide (II-A).

In many embodiments, the cooling agent is a menthoxy containing compound. In many embodiments the cooling agent and the menthoxy containing compound does not include menthol. In many of these embodiments the menthoxy containing compound has the structure (III):

(III)

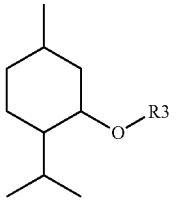

where R3 is a C1-C6 straight or branched chain alkyl or alkoxy. R3 can be unsubstituted or substituted. In some embodiments, R3 is substituted with oxygen nitrogen, or hydroxyl. Exemplary menthoxy containing compound structures include the following:

(III-A)

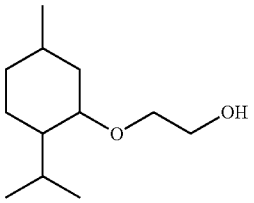

(III-B)

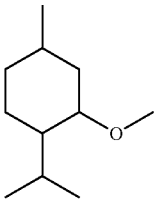

(III-C)

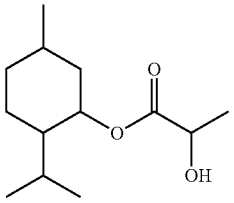

An exemplary listing of menthoxy containing compounds include: menthyl lactate (III-C also known as FEMA 3748); monomenthyl succinate; monomenthyl glutarate; menthyl pyrrolidin-2-one-5-carboxylate; menthyl ester of 4-(N,N-dimethylamino)-4-oxobutanoic acid; menthyl 3-hydroxybutyrate; 3-menthoxypropane-1,2-diol; 2-menthoxyethanol (III-A also known as FEMA 4154); menthone glycerol ketal; menthane-3,8-diol; or; or menthyl methyl ether (III-B also known as FEMA 4054).

In many embodiments, the cooling agent inclusion complex is a cyclodextrin cooling agent inclusion complex that comprises a cooling agent, such as one or more of the cooling agents described above, and a cyclodextrin. Cyclodextrin is combined with the cooling agent forming an inclusion complex between the cooling agent and the cyclodextrin. This inclusion complex is a clathrate or guest-host complex wherein the cooling agent is included in the cyclodextrin at the molecular level. The cyclodextrin forms a "trap" around the cooling agent and through molecular immobilization, ensures that cooling agent does not migrate through surfaces of the smoking article mouthpiece. When the user places their lips onto the smoking article mouthpiece and moistens the inclusion complex disposed thereon, the inclusion complex dissociates and releases the cooling agent causing a physiological cooling sensation to the user's lips or fingers.

Cyclodextrins contemplated for use in the present disclosure have cyclic structures and are capable of forming inclusion complexes with any of the cooling agents described above. Cyclodextrins with which the present disclosure is concerned include alpha-cyclodextrin, beta-cyclodextrin, gamma-cyclodextrin and mixtures thereof. Alpha-cyclodextrin is a ring-structured compound having six glucopyranose units; beta-cyclodextrin is a ring-structured compound having seven glucopyranose units; and gamma-cyclodextrin is a ring-structured compound having eight glucopyranose units. In many embodiments, the cyclodextrin utilized in the inclusion complex is beta-cyclodextrin with any of the cooling agents described above. Further details on cyclodextrin are in U.S. Pat. No. 4,751,095. Cyclodextrins are commercially available and may be utilized in the present disclosure without modification, for example.

In one embodiment, a method of making an inclusion complex of cooling agent with cyclodextrin is provided. The cyclodextrin is selected from the group consisting of alpha-cyclodextrin, beta-cyclodextrin, gamma-cyclodextrin and mixtures thereof. Preferably, the cyclodextrin is beta-cyclodextrin. Alternatively, the cyclodextrin may be beta-cyclodextrin or gamma-cyclodextrin. The inclusion complex is formed by dissolving the cyclodextrin in a medium suitable for the formation of the inclusion complex. Suitable mediums include aqueous liquids in which the cyclodextrin is soluble and in which the cooling agent is capable of being dispersed. A preferred medium is water. However, an aqueous liquid being primarily water with small amounts of alcohol is suitable as well. For example, aqueous solutions of methanol, ethanol or isopropanol in which the cyclodextrin is soluble are suitable.

In one illustrative embodiment, the cyclodextrin is dissolved in the aqueous medium at a level below its solubility limit. To this solution the cooling agent is added while simultaneously stirring the solution to disperse the cooling agent and forming the cooling agent cyclodextrin inclusion complex. The final inclusion complex product is then utilized in the manufacture of a smoking article mouthpiece.

In many embodiments, the inclusion complex is applied to tipping wrapper via printing, spraying or coating. The inclusion complex remains on the applied surface of the tipping wrapper during the manufacturing of the smoking article. In some embodiments the inclusion complex coated tipping wrapper travels through the tipping wrapper rollers, drums, breakers and wrapper operations. Surprisingly the inclusion complex remains stable, active and in place on the tipping wrapper through all these operations. Then the tipping wrapper can be applied to the mouthpiece of a smoking article, such as a filter element, for example to form the smoking article. In other embodiments the inclusion complex is applied to the outer surface of the smoking article mouthpiece during the manufacture of the smoking article. For example, the inclusion complex is sprayed or printed or coated onto the tipping wrapper when the tipping wrapper is in place on the smoking article mouthpiece.

The inclusion complex may be included on the outer surface of a mouthpiece of a conventional combustible smoking article, or it may be included on the outer surface of the mouthpiece of a non-combustible smoking article that is configured to deliver a component of tobacco using heat, air flow or chemical reaction.

It has been found that in at least one embodiment, the inclusion complex of cooling agent with cyclodextrin remained stable, active and in place on the tipping wrapper for at least six months. Thus, without the use of additional barrier layers or coatings, the cooling agent did not migrate from the applied surface of the tipping wrapper and provided physiological cooling sensation to the user's lips following six months of storage of the smoking article. The inclusion complex of cooling agent with cyclodextrin also provides no offensive taste notes during the smoking experience.

While the inclusion complex of cooling agent with cyclodextrin is illustrated below with a cigarette smoking article, the cooling agent inclusion complex can be utilized other smoking articles. These other smoking articles are designed to use heat, air flow, a chemical reaction, or a combination of these mechanisms, to deliver a component of the tobacco substrate to the consumer. Many of these non-combustible smoking articles also include a wrapper material around the mouthpiece portion, where the wrapper material comes into contact with the mouth or lips of the consumer. The inclusion complex of cooling agent with cyclodextrin can be utilized on the mouthpiece of these smoking articles to provide a physiological cooling sensation to the consumer's lips or fingers or both.

Preferably, the smoking article includes between about 0.01 mg and about 10 mg of the described cooling agents, more preferably between about 0.01 mg and about 2 mg, and most preferably between about 0.05 mg and about 1 mg. In many embodiments the cooling agent is disposed on the outer surface of the outer wrapper of the mouthpiece of the smoking article, for example across the entire surface of the outer wrapper. In many embodiments the cooling agent is uniformly disposed on the outer wrapper so as to contact both the lips and fingertips of the consumer.

Preferably the cooling agent is disposed on only a portion of the outer surface of the mouthpiece. For example, in some embodiments the cooling agent is disposed only in the first about 15 mm mouthend portion of the outer surface of the mouthpiece, preferably only in the first about 12 mm mouthend portion of the outer surface of the mouthpiece. This can allow the cooling agent to contact the lips of a consumer as the smoking article is consumed. In some other embodiments the cooling agent is disposed only beyond the first about 12 mm mouthend portion of the outer wrapper, preferably beyond the first about 15 mm mouthend portion of the outer wrapper. This can allow the cooling agent to contact the fingertips of a consumer as the smoking article is consumed. Alternatively, in some further embodiments, the cooling agent can be disposed across the whole outer surface of the mouthpiece.

The disclosure will be further described, by way of example only, with reference to the accompanying drawings, in which:

FIG. 1 shows a schematic cross section view of a smoking article according to the present disclosure having a cooling agent and cyclodextrin inclusion complex disposed on the outer surface of the mouthpiece.

The smoking article 10 shown in FIG. 1 includes a tobacco substrate or tobacco rod 12 attached to, and in axial alignment with, a mouthpiece 14, shown here as a filter 14. The mouthpiece or filter 14 includes a filter plug 16 that can be formed of cellulose acetate wrapped in plug wrap 18. Tipping wrapper 19 joins the tobacco rod 12 to the axially aligned mouthpiece or filter 14.

The cooling agent and cyclodextrin inclusion complex 20 is disposed on the outer surface of the mouthpiece or filter 14. In many embodiments the cooling agent and cyclodextrin inclusion complex 20 is disposed on the tipping wrapper 19 which forms at least a portion of the mouthpiece outer surface.

As illustrated in FIG. 1, the cooling agent and cyclodextrin inclusion complex 20 does not need a barrier layer or any other layer to prevent migration of the cooling agent and cyclodextrin inclusion complex 20. The cooling agent and cyclodextrin inclusion complex 20 remains stable, active and in place on the tipping paper for an extended period of time without the use of additional layers or coatings.

EXAMPLES

Sensory studies were performed to determine whether cigarettes having a cooling agent inclusion complex disposed on tipping paper, would provide a more intense cooling sensation, compared to identical cigarettes which had been aged by 6 months.

Three different groups of cigarettes (1P, 2P, 3P) were prepared and presented to a group of panelists for sensory studies. Each group consisted of a non-aged version of the cigarette and a corresponding version of the cigarette that had been aged by 6 months. In each case, the cigarette had been prepared with an equal amount of cooling agent on its tipping paper.

TABLE 1

Cigarette Specificaitons

| Products | Cooling agent | Application method | Cooling agent form | Ageing (months) |
|---|---|---|---|---|
| Non-aged 1P | N-Ethyl-p-menthane-3-carboxamide | Unprinted basepaper | Encapsulated in cyclodextrin | 0 |
| Aged 1P | | | | 6 |
| Non-aged 2P | | Precoated basepaper with nitrocellulose lacquer | | 0 |
| Aged 2P | | | | 6 |
| Non-aged 3P | | precoated basepaper with ethylcellulose lacquer | | 0 |
| Aged 3P | | | | 6 |

The panelists were asked to humidify their lips, insert the filter section of a first cigarette into the left side of their mouth, and draw twice on the unlit cigarette, before then removing the cigarette. The panelists were then asked to repeat this process, but with a second cigarette on the right side of their mouth. A few seconds after both cigarettes had been removed, the panelists were then asked to indicate which cigarette provided a more intense cooling sensation. Each cigarette pair was presented to a panelist 7 times in randomized order. Each cigarette pair included one non-aged cigarette and one corresponding aged cigarette as shown in table 1.

The answers provided by the panelists are shown in table 2 below.

TABLE 2

Panelist Response

| Test | Number of panelists | Minimum number for significant difference at 95% CL | Number of times the Aged Version was selected |
|---|---|---|---|
| Non-aged 1P vs. Aged 1P | 18 | 14 | 10 |

TABLE 2-continued

| Panelist Response | | | |
|---|---|---|---|
| Test | Number of panelists | Minimum number for significant difference at 95% CL | Number of times the Aged Version was selected |
| Non-aged 2P vs. Aged 2P | 19 | 15 | 10 |
| Non-aged 3P vs. Aged 3P | | | 12 |

It was found that there was no significant difference between the non-aged cigarette and the aged cigarette for each test performed. That is, the panelist studies did not overall find that cigarettes having a cooling agent inclusion complex disposed on tipping paper, would provide a more intense cooling sensation, compared to identical cigarettes which had been aged by 6 months.

The invention claimed is:

1. A smoking article comprising;

a mouthpiece having an outer surface; and a cooling agent inclusion complex disposed on the outer surface wherein the cooling agent inclusion complex is a cyclodextrin cooling agent inclusion complex comprising cyclodextrin and a non-volatile cooling agent comprising a carboxamide containing compound.

2. A smoking article according to claim 1 wherein the cooling agent is non-volatile and has a vapour pressure less than about 8.5 Pa.

3. A smoking article according to claim 1 wherein the carboxamide containing compound has the structure (I):

(I)

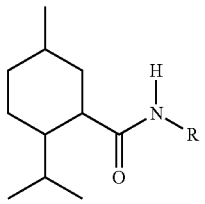

where R is a C1-C12 straight or branched chain alkyl or alkoxy, or arylene or pyridyl.

4. A smoking article according to claim 1 wherein the carboxamide containing compound has the structure (I-B):

(I-B)

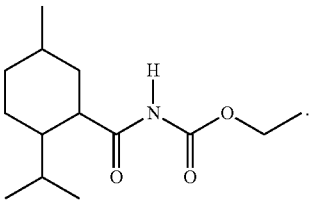

5. A smoking article according to claim 1 wherein the carboxamide containing compound is N-ethyl-p-menthane-3-carboxamide; ethyl 3-(p-menthane-3-carboxamido)acetate; N-(ethoxycarbonylmethyl)-p-menthane-3-carboxamide; N-(4-cyanomethylphenyl)-p-menthane carboxamide; N-(4-aminocarbonylphenyl)-p-menthane; or N-(4-methoxyphenyl)-p-menthanecarboxamide or N-(2-(pyridine-2-yl-)ethyl)-3-p-menthanecarboxamide.

6. A smoking article according to claim 1 wherein the carboxamide containing to compound is N-ethyl-p-menthane-3-carboxamide or ethyl 3-(p-menthane-3-carboxamido)acetate.

7. A smoking article according to claim 1 wherein the carboxamide containing compound has the structure (II):

(II)

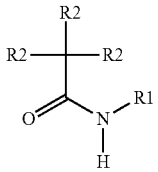

where R1 is a C1-C6 straight or branched chain alkyl or alkoxy, and each R2 is independently selected from the group consisting of C1-C3 straight or branched chain alkyl.

8. A smoking article according to claim 1 wherein the carboxamide containing compound has the structure (II-C):

(II-C)

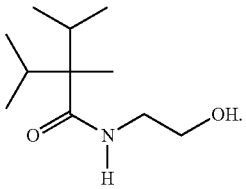

9. A smoking article according to claim 1 wherein the carboxamide containing compound is 2-isopropyl-N,2,3-trimethylbutanamide; N-(2-ethoxyethyl)-2,3-dimethyl-2-isopropylbutanamide; or N-(1-isopropyl-1-methylisobutyl) anisamide; or N-ethyl-2,2-diisopropylbutanamide; or N-(2-hydroxyethyl)-2-isopropyl-2,3-dimethylbutanamide.

10. A smoking article according to claim 1 wherein the carboxamide containing compound is 2-isopropyl-N,2,3-trimethylbutanamide.

11. A smoking article according to claim 1 wherein the carboxamide containing compound is N-ethyl-p-menthane-3-carboxamide.

12. A smoking article comprising;

a mouthpiece having an outer surface; and a cooling agent inclusion complex disposed on the outer surface wherein the cooling agent inclusion complex is a cyclodextrin cooling agent inclusion complex comprising cyclodextrin and a non-volatile cooling agent comprising a menthoxy containing compound.

13. A smoking article according to claim 12 wherein the cooling agent is non-volatile and has a vapour pressure less than about 8.5 Pa.

14. A smoking article according to claim 12 wherein the menthoxy containing compound has the structure (III):

(III)

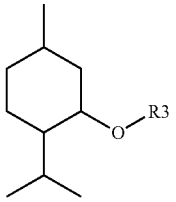

where R3 is a C1-C6 straight or branched chain alkyl or alkoxy.

15. A smoking article according to claim 12 wherein the carboxamide containing compound has the structure (III-A):

(III-A)

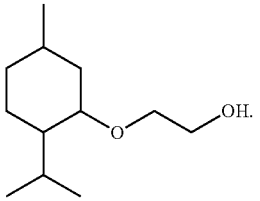

16. A smoking article according to claim 12 wherein the carboxamide containing to compound has the structure (III-C):

(III-C)

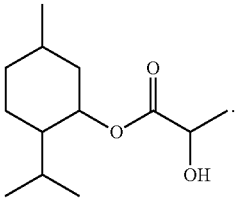

17. A smoking article according to claim 12 wherein the menthoxy containing compound is menthyl lactate; monomenthyl succinate; monomenthyl glutarate; menthyl pyrrolidin-2-one-5-carboxylate; menthyl ester of 4-(N,N-dimethylamino)-4-oxobutanoic acid; menthyl 3-hydroxybutyrate; 3-l-menthoxypropane-1,2-diol; 2-l-menthoxyethanol; menthone glycerol ketal; p-menthane-3,8-diol; or menthyl methyl ether.

* * * * *